US009964257B2

(12) United States Patent
Tamura et al.

(10) Patent No.: US 9,964,257 B2
(45) Date of Patent: May 8, 2018

(54) ILLUMINATION DEVICE FOR PREVENTING A REMOVAL OF A MODULE SUBSTRATE AND SUPPRESSING GENERATION OF A CRACK IN THE MODULE SUBSTRATE

(71) Applicant: PANASONIC INTELLECTUAL PROPERTY MANAGEMENT CO., LTD., Osaka (JP)

(72) Inventors: Tetsushi Tamura, Nigata (JP); Yukiya Kanazawa, Osaka (JP); Takuya Matsumoto, Osaka (JP); Yoshitaka Kurimoto, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 377 days.

(21) Appl. No.: 14/510,173

(22) Filed: Oct. 9, 2014

(65) Prior Publication Data

US 2015/0098230 A1 Apr. 9, 2015

(30) Foreign Application Priority Data

Oct. 9, 2013 (JP) ..... 2013-212010

(51) Int. Cl.
*F21V 19/00* (2006.01)
*F21K 99/00* (2016.01)
(Continued)

(52) U.S. Cl.
CPC ..... *F21K 9/1355* (2013.01); *F21K 9/23* (2016.08); *F21K 9/238* (2016.08); *F21V 19/005* (2013.01);
(Continued)

(58) Field of Classification Search
CPC .... F21V 29/70; F21V 19/005; F21V 19/0055; F21K 9/1355; F21K 9/23; F21K 9/237
See application file for complete search history.

(56) References Cited

U.S. PATENT DOCUMENTS

2006/0227558 A1* 10/2006 Osawa ..... F21K 9/135 362/351
2008/0224608 A1 9/2008 Konishi et al.
(Continued)

FOREIGN PATENT DOCUMENTS

JP 2008-227412 9/2008
JP 2011-82141 4/2011

OTHER PUBLICATIONS

U.S. Appl. No. 14/509,263 to Tetsushi Tamura et al., filed Oct. 8, 2014.

*Primary Examiner* — Sean Gramling
*Assistant Examiner* — Gerald J Sufleta, II
(74) *Attorney, Agent, or Firm* — Greenblum & Bernstein, P.L.C.

(57) ABSTRACT

An illumination device includes a light emitting module having a module substrate and a semiconductor light emitting element mounted to the module substrate, a base having a mounting surface on which the light emitting module is mounted, and a cover portion configured to cover an edge portion of the module substrate without pressing the edge portion. The module substrate includes a surface which is bonded to the mounting surface of the base through an adhesive layer. The base includes a protrusion provided to protrude upward from the mounting surface without being covered by the module substrate. The cover portion is provided on the protrusion.

17 Claims, 10 Drawing Sheets

(51) Int. Cl.

| | |
|---|---|
| ***F21V 29/00*** | (2015.01) |
| ***F21V 29/70*** | (2015.01) |
| ***F21K 9/23*** | (2016.01) |
| ***F21K 9/238*** | (2016.01) |
| *F21V 17/00* | (2006.01) |
| *F21V 23/00* | (2015.01) |
| *F21Y 115/10* | (2016.01) |

(52) U.S. Cl.
CPC ..... *F21V 19/0055* (2013.01); *F21V 23/006* (2013.01); *F21V 23/009* (2013.01); *F21V 29/002* (2013.01); *F21V 29/70* (2015.01); *F21V 17/005* (2013.01); *F21V 23/002* (2013.01); *F21Y 2115/10* (2016.08)

(56) References Cited

U.S. PATENT DOCUMENTS

| | | | | |
|---|---|---|---|---|
| 2011/0063842 | A1* | 3/2011 | Takei | F21V 19/004 362/249.01 |
| 2011/0089806 | A1* | 4/2011 | Suwa | F21K 9/1375 313/46 |
| 2011/0210664 | A1* | 9/2011 | Hisayasu | F21V 19/0055 315/32 |

* cited by examiner

ILLUMINATION DEVICE FOR PREVENTING A REMOVAL OF A MODULE SUBSTRATE AND SUPPRESSING GENERATION OF A CRACK IN THE MODULE SUBSTRATE

CROSS-REFERENCE TO RELATED APPLICATION

This application claims priority to Japanese Patent Application No. 2013-212010 filed on Oct. 9, 2013, the entire contents of which are incorporated herein by reference.

TECHNICAL FIELD

The present disclosure relates to an illumination device that uses a semiconductor light emitting element including an LED as a light source and, more particularly, to an illumination device in which a light emitting module formed by mounting a semiconductor light emitting element to a module substrate is installed on a base.

BACKGROUND ART

In recent years, with a view to saving energy, a lamp in which a semiconductor light emitting element including an LED (Light Emitting Diode) is used as a light source has been developed as a bulb type lamp for replacing an incandescent bulb. For example, Japanese Unexamined Patent Application Publication Nos. 2008-227412 and 2011-82141 disclose a bulb type lamp that includes a light emitting module formed by mounting a semiconductor light emitting element to a mounting substrate, a base for supporting the light emitting module, a circuit unit, a circuit holder, a metal cap and a globe.

The base serves as a heat sink that dissipates heat generated from the semiconductor light emitting element. In the lamp disclosed in Japanese Unexamined Patent Application Publication No. 2008-227412, a substrate having an LED is placed on a mounting surface of an aluminum-made base and is fixed to the base by tightening a screw. In this lamp, a ceramic substrate is often used as a module substrate that constitutes a light emitting module.

The ceramic substrate is made of a ceramic material such as an aluminum oxide, an aluminum nitride or a silicon nitride. The ceramic substrate is good in insulation property and is superior in heat dissipation property and heat resistance.

However, the ceramic-made module substrate is more brittle and fragile than a metal-made substrate. For that reason, if the ceramic-made module substrate is pressed against and fixed to the base by tightening a screw, it is sometimes the case that a stress is generated in a pressed point and a crack occurs.

Furthermore, during the use of a light emitting device, it is sometimes the case that, due to a difference in thermal expansion coefficient between a ceramic substrate and a main body, a stress is generated in the portion of the ceramic substrate pressed against a base and the ceramic substrate is broken (see paragraph 0005 of Japanese Unexamined Patent Application Publication No. 2011-82141).

The generation of a crack in the module substrate may be a cause of lighting failure. Thus, in the illumination device disclosed in Japanese Unexamined Patent Application Publication No. 2011-82141, the ceramic substrate is fixed to the base through a pressing member in a uniformly pressed state. This makes it possible to suppress breakage of the ceramic substrate while firmly fixing the ceramic substrate to the base.

In this case, however, the pressing member needs to be used. It is therefore desirable to suppress breakage of the module substrate with a simplified configuration. Moreover, even when the module substrate is pressed using the pressing member, a stress is generated in the module substrate. In particular, if the module substrate is tightly fastened at two or more points, a stress is generated and a crack is likely to occur.

SUMMARY OF THE INVENTION

In view of the above, the present disclosure provides an illumination device capable of allowing a module substrate to be mounted to a base with a simplified configuration and capable of preventing generation of a crack in the module substrate.

In accordance with an aspect of the present invention, there is provided an illumination device including: a light emitting module including a module substrate and a semiconductor light emitting element mounted to the module substrate; a base including a mounting surface on which the light emitting module is mounted; and a cover portion configured to cover an edge portion of the module substrate without pressing the edge portion, wherein the module substrate includes a surface which is bonded to the mounting surface of the base through an adhesive layer, and wherein the base includes a protrusion provided to protrude upward from the mounting surface without being covered by the module substrate and the cover portion is provided on the protrusion.

The term "an edge portion of the module substrate" referred to herein is not intended to indicate only the outer edge of the module substrate but is intended to include an edge of a through-hole or a cutout formed in the module substrate, if any.

The cover portion is essentially out of contact with the edge portion of the module substrate. However, the cover portion may be connected to the edge portion of the module substrate through a filler or the like, as long as the cover portion does not apply a pressure to the edge portion of the module substrate.

The illumination device mentioned above may be configured as follows.

A through-hole may be formed in a region of the module substrate excluding a region where the semiconductor light emitting element exists. The protrusion may pass through the through-hole. The edge portion of the module substrate may include an edge of the through-hole.

The cover portion may be larger in diameter than the protrusion and is fixed to a top portion of the protrusion.

The cover portion may be fixed to the protrusion by a shaft having a head portion and mounted to the base. The base may further include a rib provided on the mounting surface thereof. The rib may serve to position the module substrate on the mounting surface.

The module substrate may be made of a ceramic material.

The adhesive layer may be made of a thermally conductive material.

The adhesive layer may cover only a portion of the surface of the module substrate.

A circuit unit may be configured to drive the light emitting module and a circuit case may accommodate and hold the circuit unit in its internal space. The circuit unit and the circuit case may be provided at the side of a rear surface of the base opposite to the mounting surface. The circuit case may include a tubular portion having an opening disposed so as to face toward the rear surface and an insulation portion interposed between the rear surface of the base and the circuit unit so as to cover the opening of the tubular portion. The insulation portion may include a window through which the internal space of the circuit case leads to the rear surface of the base.

According to the illumination device mentioned above, the module substrate is essentially bonded and fixed to the mounting surface of the base through the adhesive layer. While the cover portion installed on the protrusion covers the edge of the module substrate, no pressing force is applied to the module substrate. Accordingly, even if the module substrate is a fragile substrate such as a ceramic substrate or the like, there is no possibility that a crack occurs in the module substrate.

Furthermore, if the adhesive layer is peeled off and if the module substrate attempts to move away from the mounting surface, the cover portion of the protrusion comes into contact with the module substrate, thereby restricting the movement of the module substrate. Accordingly, even if the adhesive layer is degraded, there is no possibility that the module substrate is removed from the base. Moreover, when compared with a case where a module substrate is fixed by a screw through a pressing plate, the pressing plate becomes unnecessary. As a result, the number of parts is reduced and the mounting work is simplified.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION (History of the Invention)

As mentioned earlier, in the related art, a fastener such as a screw or the like is essentially used to press a module substrate against a base.

In contrast, the present inventors have changed the conventional idea of pressing the module substrate. The bonding of the module substrate to the base is performed by an adhesive agent. The fastener such as a screw or the like is not used in pressing the module substrate but is used in forming a cover portion that prevents removal of the module substrate.

This makes it possible to prevent removal of the module substrate while suppressing generation of a crack in the module substrate.

(Embodiment)

<Overall Configuration>

Figure 1:
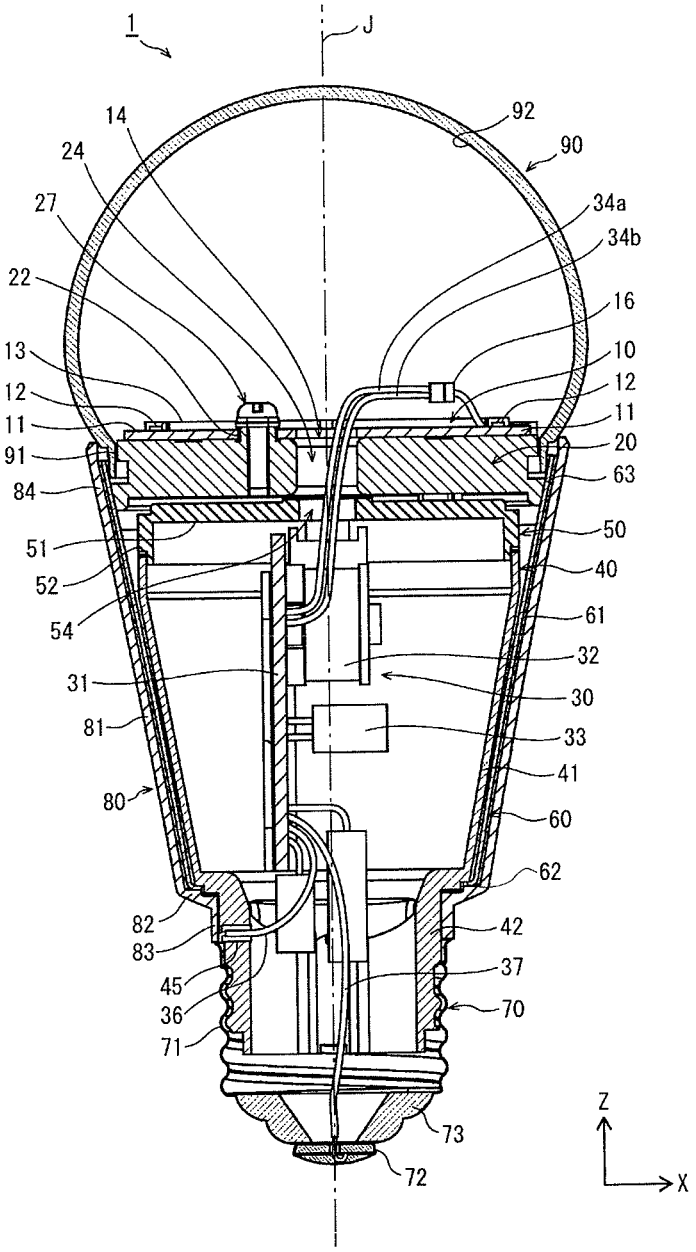
FIG. 1 is a vertical sectional view showing a lamp according to an embodiment.
Figure 2:
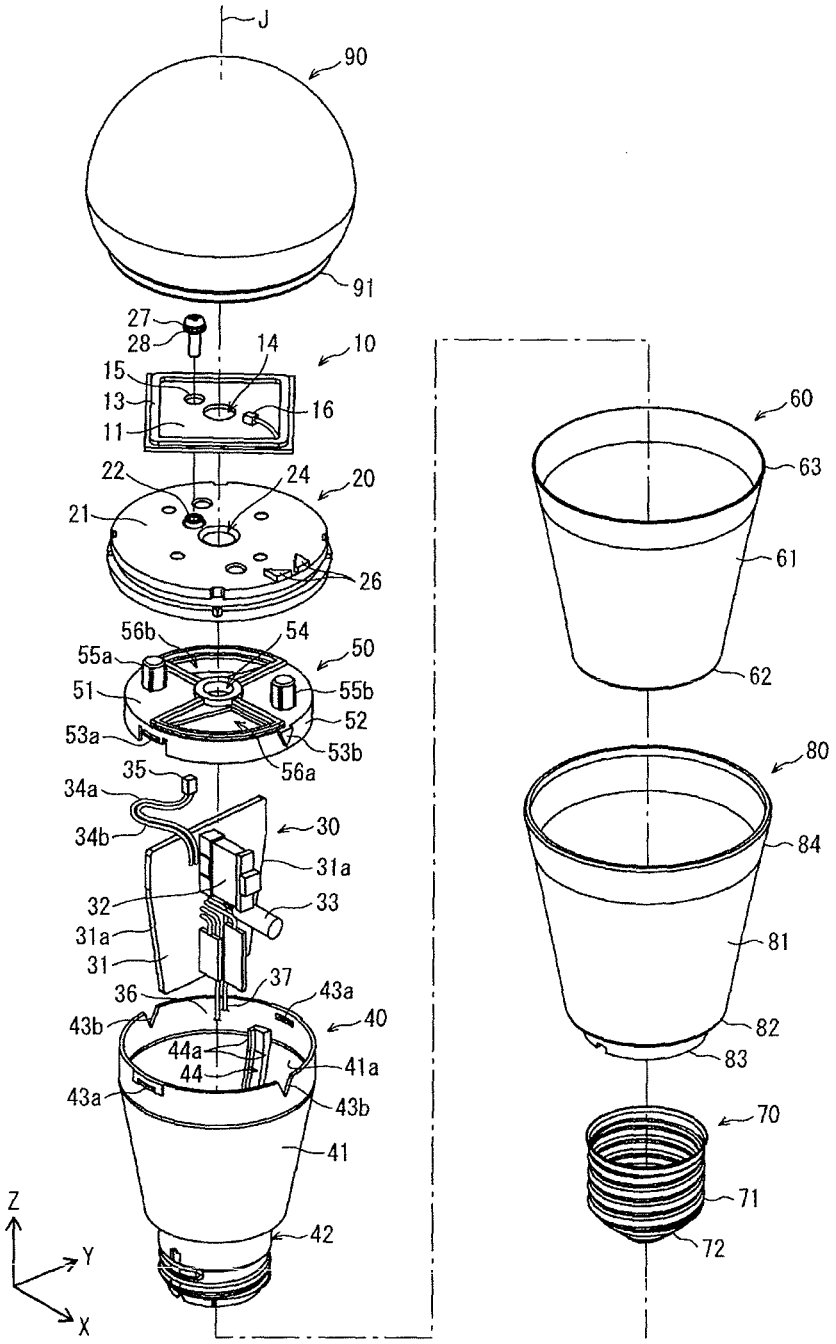
FIG. 2 is an exploded perspective view of the lamp.
Figure 3:
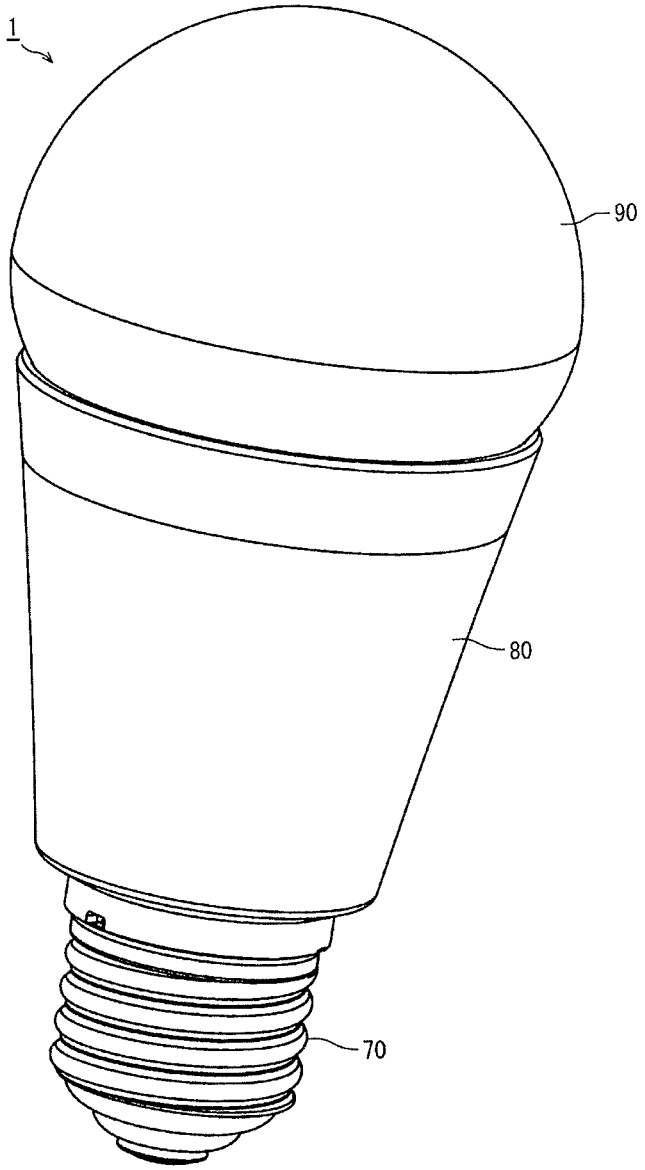
FIG. 3 is an external perspective view of the lamp.

As shown in FIGS. 1 to 3, a lamp 1 is an LED lamp used as a substitute of an incandescent bulb.

Referring to FIG. 1, a single-dot chain line extending in an up-down direction on a drawing sheet indicates a lamp axis J of the lamp 1. The lamp axis J is an axis about which the lamp 1 rotates when the lamp 1 is mounted to a socket of a luminaire. The lamp axis J coincides with a rotation axis of a metal cap 70. The upper side on the drawing sheet in FIG. 1 will be referred to as a front side of the lamp 1.

As shown in FIGS. 1 and 2, the lamp 1 includes a light emitting module 10, a base 20 to which the light emitting module 10 is mounted, a circuit unit 30 for driving the light emitting module 10, a circuit case (a tubular portion 40 and an insulation portion 50) for accommodating the circuit unit 30 therein, an internal housing 60, a metal cap 70, an external housing 80, a globe 90, and so forth.

Configurations of the respective parts will now be described in detail.

<Light Emitting Module 10>

The light emitting module 10 includes a module substrate 11, a plurality of semiconductor light emitting elements 12 mounted to the module substrate 11 and an encapsulation member 13 encapsulating the semiconductor light emitting elements 12.

As shown in FIG. 2, the encapsulation member 13 is formed into a ring shape on an upper surface of an outer periphery portion of the module substrate 11. A wiring pattern is formed on the upper surface of the outer periphery portion of the module substrate 11. The semiconductor light emitting elements 12 are mounted on the wiring pattern. The wiring pattern and the semiconductor light emitting elements 12 are not visible in FIG. 2 because they are covered with the encapsulation member 13.

A power-feeding connector 16 is connected to the wiring pattern of the module substrate 11. The module substrate 11 used in the present embodiment is a ceramic substrate formed by mixing a glass component with a ceramic such as an aluminum oxide, an aluminum nitride or a silicon nitride and baking the mixed material. A wiring pattern is formed on the ceramic substrate. However, the module substrate 11 is not limited to the ceramic substrate. Other substrates such as a resin substrate and a metal-based substrate formed of a resin and a metal may be used as the module substrate 11.

For example, GaN-based LEDs that emit blue light are used as the semiconductor light emitting elements 12. The semiconductor light emitting elements 12 are mounted on the upper surface of the outer periphery portion of the module substrate 11 through the use of a COB (Chip-On-Board) technique.

The encapsulation member 13 is configured by mixing a wavelength conversion material, which is capable of converting the wavelength of the light emitted from the semiconductor light emitting elements 12, into a light transmitting material. For example, a silicon resin is used as the light transmitting material. For example, yellow phosphor particles for converting blue light to yellow light can be used as the wavelength conversion material.

A through-hole 14 through which lead wires 34*a* and 34*b* for receiving electric power from the circuit unit 30 pass is formed in the central portion of the module substrate 11.

Furthermore, a through-hole 15 is formed in the module substrate 11. A protrusion 22 of the base 20 is fitted into the through-hole 15.

The through-hole 14 and the through-hole 15 are formed in a central portion of the module substrate 11 where the wiring pattern is not disposed.

In the present embodiment, the light emitting unit is formed of COB type LEDs. Alternatively, the light emitting unit may be formed of SMD (surface mount device) type LEDs.

<Base 20>

As shown in FIG. 2, the base 20 is a substantially disc-shaped member. The upper surface of the base 20 serves as a mounting surface 21 on which the light emitting module 10 is mounted. The light emitting module 10 is bonded and fixed to the mounting surface 21 through an adhesive layer 18 (see FIG. 4B). The base 20 is made of a thermally conductive material so that the heat generated in the light emitting module 10 can be efficiently dissipated to the outside.

The base 20 may be manufactured by injection-molding a thermally conductive resin or may be manufactured by pressing or die-casting a thermally conductive material such as a metal or the like.

Examples of the thermally conductive material may include a pure metal composed of a single metal element such as aluminum, tin, zinc, indium, iron, copper, silver, nickel, rhodium, palladium or the like, an alloy composed of a plurality of metal elements, and an alloy composed of a metal element and a nonmetal element.

Examples of the thermally conductive resin material may include polypropylene, polypropylene sulfide, polycarbonate, polyetherimide, polyphenylene sulfide, polyphenylene oxide, polysulfone, polybutylene terephthalate, polyamide, polyethylene terephthalate, polyether sulfone, and polyphthalamide.

A mixture of a resin material and a thermally conductive filler may be used. As the thermally conductive filler, it is possible to use, e.g., a filler composed of an inorganic material such as glass, silicon oxide, beryllium oxide, aluminum oxide, magnesium oxide, zinc oxide, silicon nitride, boron nitride, titanium nitride, aluminum nitride, diamond, graphite, silicon carbide, titanium carbide, zirconium boride, phosphorus boride, molybdenum silicide, beryllium sulfide, aluminum, tin, zinc, indium, iron, copper, silver or the like. Different kinds of fillers may be used in combination.

As shown in FIG. 2, a through-hole 24 is formed in the central portion of the base 20. As will be described later in detail, the lead wires 34*a* and 34*b* are inserted through the through-hole 24. The base 20 includes the protrusion 22 and a pair of ribs 26, both of which protrude from the mounting surface 21. A pair of depressions 25*a* and 25*b* for mounting the insulation portion 50 of the circuit case is formed on a rear surface 29 of the base 20 (see FIG. 6).

<Circuit Unit 30>

The circuit unit 30 receives electric power from the illumination device through the metal cap 70. The circuit unit 30 serves to convert the electric power and to supply the converted electric power to the light emitting module 10. The circuit unit 30 includes a circuit board 31, a plurality of electronic parts 32 and 33 mounted on one major surface (the mounting surface) of the circuit board 31, and a wiring pattern (not shown) arranged on the other major surface (the surface opposite from the mounting surface) of the circuit board 31. In the figures, only some of the electronic parts are designated by reference symbols "32" and "33".

The circuit unit 30 is held on the rear surface 29 of the base 20 by the circuit case. As shown in FIG. 1, the circuit board 31 is disposed in a position deviated from the lamp axis J. This makes it possible to mount an electronic part having a large volume to the circuit board 31.

A pair of lead wires 34*a* and 34*b* for supplying electric power to the light emitting module 10 is connected to the circuit unit 30. A connector 35 is connected to the tips of the lead wires 34*a* and 34*b*.

The lead wires 34*a* and 34*b* extend toward the front side through the through-hole 54 of the insulation portion 50, the through-hole 24 of the base 20 and the through-hole 14 of the light emitting module 10. The connector 35 is attached to the tips of the lead wires 34*a* and 34*b*. The connector 35 is connected to the connector 16 attached to the light emitting module 10. In this way, a power supply line extending from the circuit unit 30 to the light emitting module 10 is formed by the lead wires 34*a* and 34*b*.

As shown in FIG. 1, the circuit unit 30 and the metal cap 70 are electrically connected to each other by a pair of lead wires 36 and 37.

<Circuit Case>

The circuit case includes a tubular portion 40 and an insulation portion 50, both of which are provided at the side of the rear surface 29 of the base 20.

The tubular portion 40 is arranged such that the front opening thereof faces toward the rear surface 29 of the base 20. The insulation portion 50 is attached so as to close the opening of the tubular portion 40. The insulation portion 50 is interposed between the rear surface 29 of the base 20 and the circuit unit 30. The axis of the circuit case coincides with the lamp axis J.

The tubular portion 40 is a tubular member having a large diameter portion 41 and a small diameter portion 42. The tubular portion 40 holds the circuit unit 30 therein. The front opening of the large diameter portion 41 of the tubular portion 40 faces toward the rear surface of the base 20. The small diameter portion 42 extends from the rear end of the large diameter portion 41. The metal cap 70 is externally fitted to the small diameter portion 42.

The large diameter portion 41 has a cylindrical shape with the diameter thereof gradually decreasing from the front side toward the back side. The circuit unit 30 is mostly accommodated within the large diameter portion 41.

As shown in FIG. 2, a pair of ribs 44*a* extending parallel to each other along the lamp axis J is provided on the inner circumferential surface 41*a* of the large diameter portion 41. A groove 44 is formed between the ribs 44*a*.

In FIG. 2, the ribs 44*a* and the groove 44 are shown at one point on the inner circumferential surface 41*a*. In reality, two pairs of ribs 44*a* and two grooves 44 are formed at two points. The opposite edges 31*a* of the circuit board 31 are respectively inserted into the two grooves 44, whereby the circuit board 31 is held within the tubular portion 40 with the major surfaces thereof extending along the lamp axis J.

The tubular portion 40 is made of, e.g., an electric insulation material such as a resin material or an inorganic material.

Examples of the resin material may include a thermoplastic resin and a thermosetting resin. More specifically, examples of the resin material may include polybutylene terephthalate, polyoxymethyl, polyamide, polyphenyl sulfide, polycarbonate, acryl, fluorine-based acryl, silicon-based acryl, epoxy acrylate, polystyrene, acrylonitrile styrene, cycloolefin polymers, methyl styrene, fluorene, polyethylene terephthalate, polypropylene, phenol resins, and melamine resins.

Examples of the inorganic material may include glass, ceramics, silica, titania, alumina, silica alumina, zirconia, zinc oxide, barium oxide, strontium oxide, and zirconium oxide.

The insulation portion 50 is mounted to the front end opening of the large diameter portion 41 of the tubular portion 40 so as to close the opening of the tubular portion 40. The insulation portion 50 is interposed between the rear surface 29 of the base 20 and the circuit board 31 of the lamp 1. The insulation portion 50 serves to provide insulation by preventing the circuit board 31 from getting closer to the rear surface 29 of the base 20.

The insulation portion 50 is a cap-shaped member mounted to the front end opening of the large diameter portion 41. The insulation portion 50 includes a disc-shaped top plate portion 51 and a circumferential wall portion 52 bent backward from the outer edge of the top plate portion 51.

The insulation portion 50 may be made of the same material as the tubular portion 40. As shown in FIG. 1, the circumferential wall portion 52 has an outer diameter substantially equal to the diameter of the front edge of the large diameter portion 41. The rear edge of the circumferential wall portion 52 is fitted into the front edge of the large diameter portion 41.

A claw 53*a* and a lug 53*b* are formed on the outer circumferential surface of the circumferential wall portion 52. In the front end portion of the large diameter portion 41, there are formed an engagement hole 43*a* with which the claw 53*a* engages and a cutout 43*b* into which the lug 53*b* is fitted. As the claw 53*a* and the engagement hole 43*a* engage with each other, the insulation portion 50 is mounted to the front end of the tubular portion 40.

Figure 6:
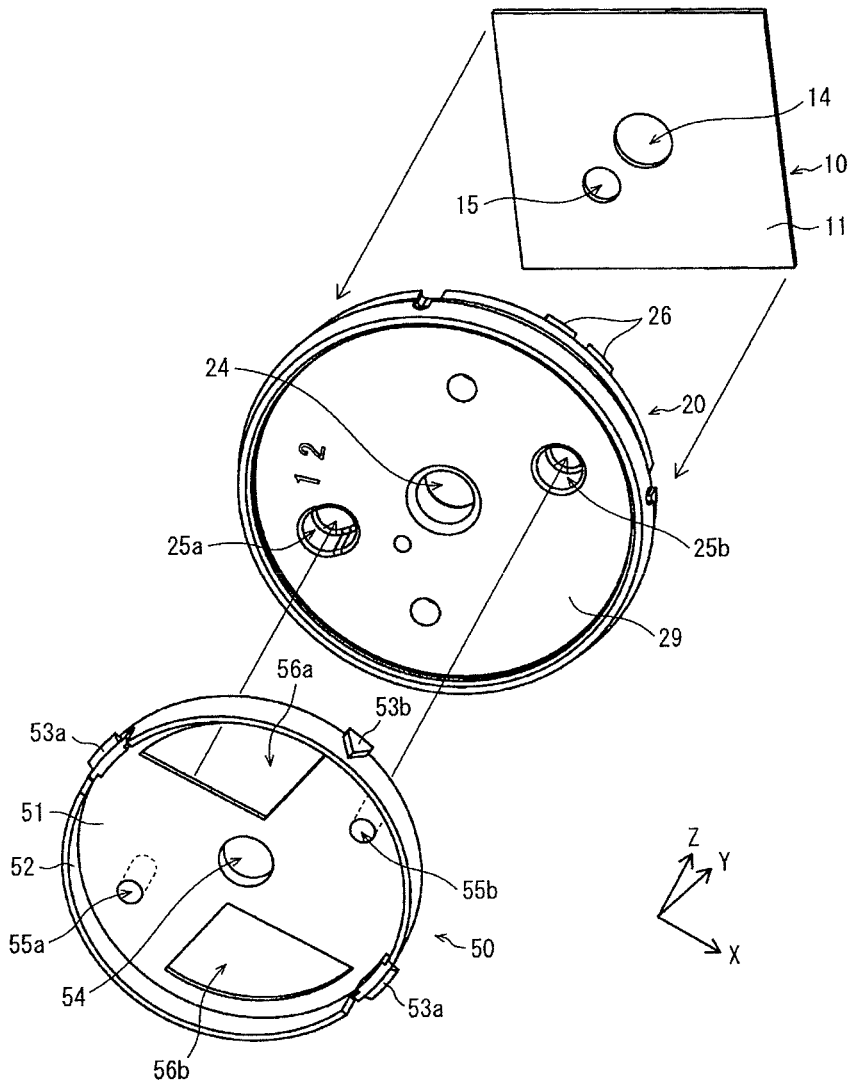
FIG. 6 is a rear exploded perspective view of a base and an insulation portion.

As shown in FIG. 2, a pair of projections 55*a* and 55*b* protruding forward from the top plate portion 51 is formed in the insulation portion 50. The projections 55*a* and 55*b* are inserted into the depressions 25*a* and 25*b* of the base 20 as shown in FIG. 6.

As the projections 55*a* and 55*b* are fitted into the depressions 25*a* and 25*b*, the insulation portion 50 is positioned adjacent to the rear surface 29 of the base 20 and is fixed in an aligned state. This makes it easy to perform an assembling work of the lamp 1.

When the lamp 1 is in an assembled state, as shown in FIG. 1, the top plate portion 51 of the insulation portion 50 is interposed between the base 20 and the circuit unit 30. Thus, the base 20 and the circuit unit 30 are spaced apart from each other. This provides insulation between the base 20 and the circuit unit 30.

Windows 56*a* and 56*b* are formed in the top plate portion 51 of the insulation portion 50. The windows 56*a* and 56*b* as a whole face toward the rear surface 29 of the base 20. Thus, the internal space of the circuit case leads to the rear surface 29 of the base 20 through the windows 56*a* and 56*b* as will be described later. For that reason, heat is well transferred between the internal space of the circuit case and the base 20 by radiation and convection.

In order to obtain the heat dissipation effect, the opening ratio of the windows 56*a* and 56*b* in the top plate portion 51 is preferably 1/5 (20%) or more and more preferably 1/3 or more. On the other hand, for the purpose of securing the strength of the insulation portion 50, the opening ratio is preferably 3/5 or less.

The term "opening ratio" referred to herein means the ratio of an occupying area of the windows to a surface area of the top plate portion 51 including the area of the windows.

One window may be formed in the top plate portion 51. However, if windows are dispersedly formed at a plurality of points, the windows are disposed over a wide region of the rear surface 29 of the base 20. This makes it possible to increase the heat dissipation effect.

Furthermore, if a gap exists between the rear surface 29 of the base 20 and the top plate portion 51, an air flows through the windows and the gap. Thus, it can be expected that the heat dissipation effect is enhanced.

<Internal housing 60>

The internal housing 60 is a cylindrical member that covers the outer circumferential surface of the large diameter portion 41 of the tubular portion 40.

The internal housing 60 is made of a thermally conductive material. The internal housing 60 serves as a heat dissipation member (heat sink) that, when the lamp 1 is turned on, dissipates the heat generated from the light emitting module 10 and the circuit unit 30 toward the metal cap 70.

The internal housing 60 may be made of the same material as the base 20. The internal housing 60 includes a cylindrical body portion 61 and a ring-shaped locking portion 62 extending from the lower end of the body portion 61. The body portion 61 has a diameter gradually decreasing from the front side toward the back side. The body portion 61 is externally fitted to the large diameter portion 41 of the tubular portion 40.

As shown in FIG. 1, the base 20 is internally fitted to a front end portion 63 of the body portion 61. The front end portion 63 of the internal housing 60 is fixed to the outer circumferential portion of the base 20 by caulking or the like.

The outer circumferential surface of the base 20 makes face-to-face contact with the inner circumferential surface of the front end portion 63 of the internal housing 60. Thus, heat is easily transferred from the base 20 to the internal housing 60.

The heat transferred from the base 20 to the internal housing 60 is predominantly transferred to the metal cap 70 via the small diameter portion 42 of the tubular portion 40 and is dissipated from the metal cap 70 toward the luminaire.

<Metal Cap 70>

The metal cap 70 is a member that receives electric power from the socket of the luminaire when the lamp 1 is turned on.

The metal cap 70 is attached so as to close the opening of the small diameter portion 42 of the tubular portion 40. The kind of the metal cap 70 is not particularly limited. In the present embodiment, an E26 metal cap of Edison type is used as the metal cap 70. The metal cap 70 includes a substantially cylindrical shell portion 71 having a male thread formed on the outer circumferential surface thereof and an eyelet portion 72 attached to the shell portion 71 through an insulation portion 73.

The lead wire 36 connected to the circuit unit 30 is extended through a through-hole 45 of the small diameter portion 42 of the tubular portion 40 to be connected to the shell portion 71. The lead wire 37 is extended through the small diameter portion 42 to be connected to the eyelet portion 72.

If the metal cap 70 is attached to the socket of the luminaire, electric power is supplied from the luminaire to the circuit unit 30 via the metal cap 70 and the lead wires 36 and 37.

<External housing 80>

The external housing 80 includes a tubular outer shell portion 81 for covering the outer circumferential surface of the internal housing 60, a circular ring portion 82 bent from the rear end of the outer shell portion 81 toward the lamp axis J, and a tubular insulation portion 83 extending backward from the inner edge of the circular ring portion 82.

The external housing 80 is made of an electric insulation material. Specific examples of the electric insulation material may include a resin material or an inorganic material identical with the material of the tubular portion 40 described above.

The outer shell portion 81 has a substantially cylindrical shape with the diameter thereof gradually decreasing from the front side toward the back side. The internal housing 60 and the large diameter portion 41 are accommodated within the outer shell portion 81. As shown in FIG. 1, the circular ring portion 82 presses the locking portion 62 of the internal housing 60 against the large diameter portion 41, thereby fixing the internal housing 60 to the tubular portion 40 of the circuit case.

The insulation portion 83 is externally fitted to the root portion of the small diameter portion 42. Since the insulation portion 83 is interposed between the body portion 61 of the internal housing 60 and the metal cap 70, electric insulation is provided between the internal housing 60 and the metal cap 70.

The front edge portion 84 of the external housing 80 surrounds the outer circumferential surface of the base 20.

<Globe 90>

The globe 90 is a substantially dome-shaped member that covers the front side of the light emitting module 10. The globe 90 is made of, e.g., a light-transmitting resin material or a glass.

As shown in FIG. 1, an opening-side end portion 91 of the globe 90 is inserted between the outer circumferential surface of the base 20 and the front edge portion 84 of the external housing 80 and is fixed thereto by an adhesive agent (not shown).

An inner surface 92 of the globe 90 may be subjected to a diffusion treatment so as to diffuse the light emitted from the light emitting module 10. As a diffusion treatment method, it is possible to use, e.g., a method by which a mixture of silica or white pigment and a coating material is coated on the inner surface 92 of the globe 90.

<Mounting of Light Emitting Module 10 to Base 20>

Figure 4A:
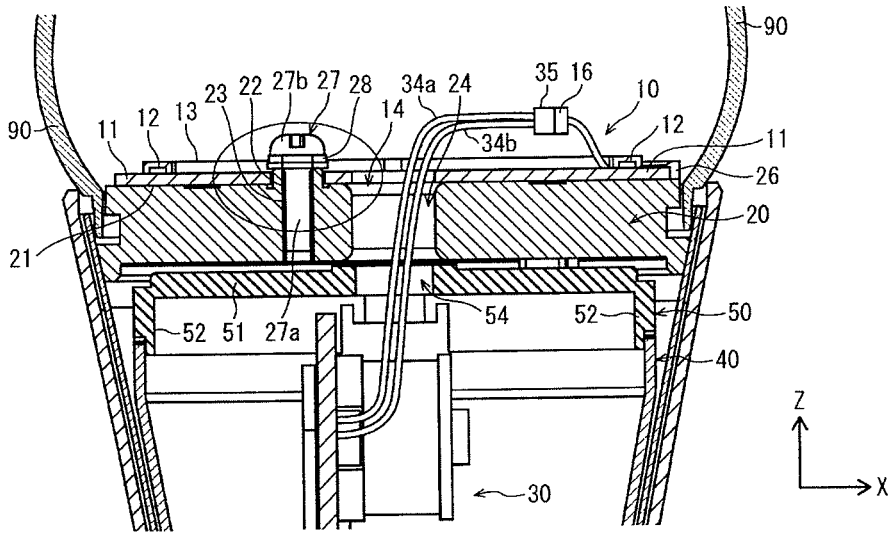
FIG. 4A is a partially enlarged view of the lamp shown in FIG. 1.
Figure 4B:
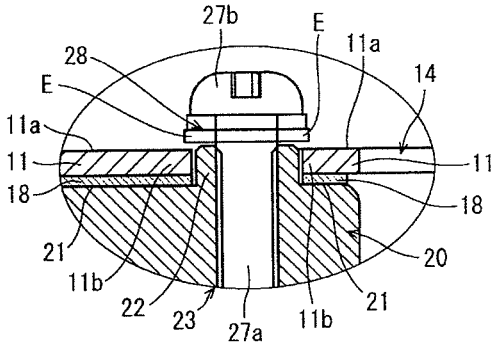
FIG. 4B is an enlarged view of the portion indicated by an ellipse in FIG. 4A.
Figure 5:
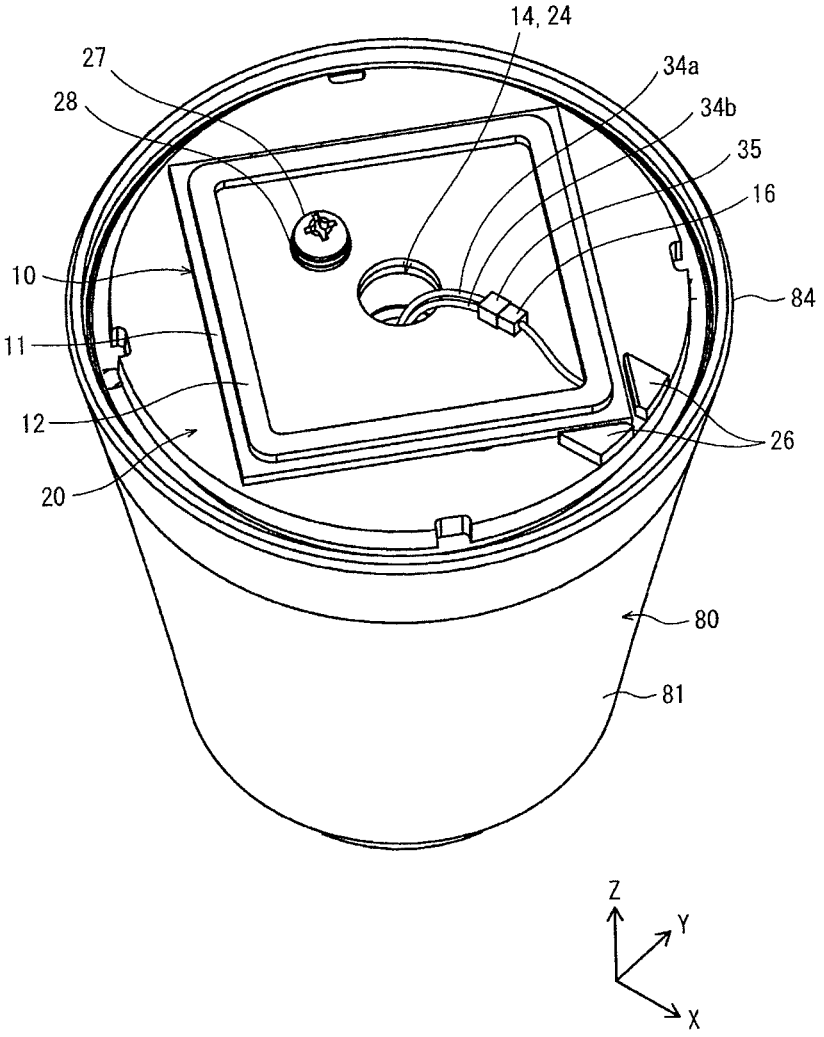
FIG. 5 is a partial perspective view of the lamp with a globe removed.

As shown in FIGS. 4A to 5, the light emitting module 10 is mounted on the mounting surface 21 of the base 20.

The module substrate 11 is mounted on the mounting surface 21 in such a positioning state that the through-hole 15 of the module substrate 11 is fitted to the protrusion 22 of the base 20 and that one corner portion of the module substrate 11 is inserted between the ribs 26.

As described above, the base 20 is provided with the protrusion 22 and the ribs 26, both of which serve to reliably position the module substrate 11 in place on the mounting surface 21. Thus, the ease of a work of mounting the light emitting module 10 to the base 20 is enhanced.

As can be noted from a partially enlarged view shown in FIG. 4B, an adhesive layer 18 is interposed between the rear surface of the module substrate 11 of the light emitting module 10 and the mounting surface 21 of the base 20. The module substrate 11 is bonded to the mounting surface 21 by the adhesive layer 18.

The adhesive layer 18 is formed of an adhesive material superior in heat conductivity, e.g., a silicon adhesive agent. The heat conductivity of the material of the adhesive layer 18 is preferably 0.1 W/m·K or higher and more preferably 0.5 W/m·K or higher.

In order to increase the heat conductivity of the adhesive layer 18, a filler having a high heat conductivity may be contained in the adhesive layer 18. The filler described above in respect of the base 20 may be used as the thermally conductive filler.

The adhesive layer 18 can be formed by coating a silicon adhesive agent on the mounting surface 21 or the rear surface of the module substrate 11 or attaching a silicon adhesive sheet to the mounting surface 21 or the rear surface of the module substrate 11 before the light emitting module 10 is mounted to the mounting surface 21.

In this way, the module substrate 11 and the mounting surface 21 of the base 20 are bonded to each other by the adhesive layer 18. For that reason, the heat generated in the light emitting module 10 is efficiently transferred to the base 20 and is dissipated to the outside through the base 20.

The adhesive layer 18 may cover the entirety of the rear surface of the module substrate 11. Alternatively, the adhesive layer 18 may cover only a portion of the rear surface of the module substrate 11. In this case, when mounting the light emitting module 10 to the mounting surface 21, it is possible to reduce the force required in pressing the light emitting module 10 against the mounting surface 21. This is because the adhesive agent is coated on only a portion of the rear surface of the module substrate 11. Accordingly, it is possible to suppress generation of a crack in the module substrate 11 when assembling the illumination device.

The base 20 is provided with a removal-preventing mechanism that prevents the light emitting module 10 from being removed from the base 20 even when the adhesive layer 18 for bonding the module substrate 11 and the mounting surface 21 is peeled off.

Description will now be made on the removal-preventing mechanism.

(Mechanism for Preventing Removal of the Light Emitting Module 10)

As shown in FIGS. 2, 4A and 4B, the base 20 is provided with the protrusion 22 that protrudes upward from the mounting surface 21 so as to pass through the through-hole 15 of the module substrate 11. That is to say, the protrusion 22 is provided in close proximity to the inner edge of the through-hole 15. Alternatively, the protrusion 22 may make contact with the inner edge of the through-hole 15 of the module substrate 11. In other words, by stating that "the protrusion is provided in close proximity to the edge portion of the module substrate", it is meant that the protrusion may make contact with the edge portion of the module substrate or may remain out of contact with the edge portion of the module substrate with a gap left therebetween.

A washer 28 having a diameter larger than the diameter of the protrusion 22 is fastened to the top surface of the protrusion 22 by a fastener 27.

In the present embodiment, a screw having a shaft portion 27*a* and a head portion 27*b* is used as the fastener 27. In order to fasten the washer 28 to the top surface of the protrusion 22, a male thread is formed on the outer circumferential surface of the shaft portion 27*a* and a thread hole 23 is formed in the portion of the base 20 where the protrusion 22 exists. The thread hole 23 is formed to extend through the thickness of the entirety of the base 20 including the protrusion 22.

The washer 28 is fastened to the top surface of the protrusion 22 by threadedly coupling the shaft portion 27*a* to the thread hole 23 in such a state that the shaft portion 27*a* is inserted through the washer 28.

By using the screw as the fastener 27 in this manner, the washer 28 can be easily fastened to the top surface of the protrusion 22 after the light emitting module 10 is mounted to the base 20.

As shown in FIG. 4B, the outer diameter of the washer 28 is set larger than the diameter of the top surface of the protrusion 22. Thus, the outer periphery portion of the washer 28 is protruded beyond the side surface of the protrusion 22, thereby forming a cover portion E.

Since the diameter of the washer 28 is set larger than the diameter of the through-hole 15, the cover portion E covers an edge portion 11*b* of the module substrate 11 (the inner edge portion of the through-hole 15). That is to say, when the mounting surface 21 is seen in a plan view from the front side, the cover portion E overlaps with the edge portion 11*b* of the module substrate 11.

Inasmuch as the height of the protrusion 22 is set equal to or larger than the thickness of the module substrate 11, the distance from the mounting surface 21 to the lower surface of the cover portion E is equal to or larger than the thickness of the module substrate 11.

Accordingly, the cover portion E does not apply any pressing force to the upper surface 11*a* of the module substrate 11. That is to say, the cover portion E and the upper surface 11*a* of the module substrate 11 are out of contact with each other, or even if the cover portion E and the upper surface 11*a* of the module substrate 11 make contact with each other, the cover portion E does not apply any pressing force to the upper surface 11*a* of the module substrate 11.

As mentioned above, there is provided the mechanism for preventing removal of the light emitting module 10. Therefore, for example, if the module substrate 11 attempts to move away from the mounting surface 21 (in the Z direction) when the adhesive layer 18 is degraded and when the module substrate 11 and the mounting surface 21 are detached from each other, the edge portion 11*b* of the module substrate 11 makes contact with the cover portion E, thereby preventing movement of the module substrate 11.

Accordingly, the light emitting module 10 is prevented from being removed from the base 20. Moreover, the module substrate 11 of the light emitting module 10 does not receive any pressing force from the cover portion E. Therefore, there is no possibility that the module substrate 11 is cracked by a pressing force.

<Effect of the Lamp 1>

As described above, the lamp 1 includes the light emitting module 10 having the light emitting unit formed by mounting the semiconductor light emitting elements 12 on the module substrate 11, and the base 20 having the mounting surface 21 on which the light emitting module 10 is mounted.

The rear surface of the module substrate 11 is bonded to the mounting surface 21 through the adhesive layer 18. The base 20 is provided with the protrusion 22 that protrudes from a region of the mounting surface 21 which is not covered with the module substrate 11. The cover portion E that covers the edge portion 11*b* of the module substrate 11 without pressing the edge portion 11*b* is fixed to the protrusion 22.

In the lamp 1, the module substrate 11 is essentially bonded and fixed to the mounting surface 21 of the base 20 through the adhesive layer 18. Furthermore, the cover portion E fixed to the protrusion 22 covers the edge portion 11*b* of the module substrate 11 in a contactless state. Thus, no pressing force is applied to the module substrate 11. Accordingly, even if the module substrate 11 is made of a ceramic material, no crack occurs in the module substrate 11. This holds true in case where the module substrate 11 is made of a resin.

If the module substrate 11 attempts to move away from the mounting surface 21 (toward the front side) when the adhesive layer 18 is peeled off due to the degradation thereof or other causes, the cover portion E of the protrusion 22 comes into contact with the module substrate 11, thereby restricting the movement of the module substrate 11. Moreover, the position of the module substrate 11 on the mounting surface 21 is fixed by the protrusion 22 and the ribs 26. Accordingly, even if the adhesive layer 18 is degraded, there is no such case that the module substrate 11 is removed from the base 20.

Furthermore, the mounting of the light emitting module 10 to the base 20 is easy because it is only necessary that the light emitting module 10 is attached to the mounting surface 21 of the base 20 and the washer 28 is fastened to the protrusion 22 by the fastener 27. As compared with the conventional case in which a light emitting module is fixed by a screw through a pressing plate, the pressing plate becomes unnecessary. This makes it possible to reduce the number of parts.

In the lamp 1, the windows 56*a* and 56*b* are formed in the top plate portion 51 of the insulation portion 50. As a result, the internal space of the circuit case leads to the rear surface 29 of the base 20 through the windows 56*a* and 56*b*. Thus, heat is well transferred between the internal space and the base 20.

Accordingly, if the temperature of the circuit unit 30 becomes higher when the lamp is turned on, heat is efficiently transferred from the circuit unit 30 to the base 20 through the windows 56*a* and 56*b* and can be dissipated to the outside through the base 20.

<Modified Examples of Removal-Preventing Mechanism>

1. In the description made above, the screw is used as the fastener 27. Alternatively, a rivet having a shaft portion and a head portion may be used as the fastener 27. By press-fitting the shaft portion of the rivet into the hole of the protrusion 22, it is equally possible to fasten the washer 28 to the top portion of the protrusion 22.

2. In the light emitting module 10 described above, the light emitting unit is installed in the outer periphery portion of the module substrate 11 and the through-hole 15 is formed in the central portion of the module substrate 11. However, the position of the through-hole 15 is not limited to the central portion of the module substrate 11. For example, if the light emitting unit is installed in the central portion of the module substrate 11, the through-hole 15 may be formed in the outer periphery portion of the module substrate 11 and the protrusion 22 of the base 20 may be provided in alignment with the through-hole 15.

Figure 7A:
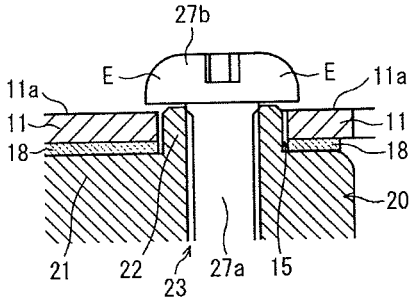
FIGS. 7A to 7D are sectional views showing cover portions according to different modified examples.

3. As shown in FIG. 7A, the washer may not be used. The mechanism for preventing removal of the light emitting module 10 may be formed by merely fastening the fastener 27 to the thread hole.

In this case, the outer diameter of the head portion 27*b* of the fastener 27 is set larger than the diameter of the through-hole 15 such that the outer periphery portion of the head portion 27*b* becomes the cover portion E. That is to say, if the adhesive layer 18 is degraded and if the module substrate 11 attempts to move away from the mounting surface 21 of the module substrate 11, the edge portion of the through-hole 15 of the module substrate 11 comes into contact with the cover portion E (the outer periphery portion of the head portion 27*b*). Thus, the removal of the light emitting module 10 is prevented.

4. As shown in FIGS. 7B to 7D or FIGS. 8A and 8B, the cover portion E may be attached beforehand to the protrusion 22 of the base 20. Then, the protrusion 22 and the cover portion E may be inserted into the through-hole 15 of the module substrate 11.

In this case, if the cover portion E is made elastically deformable, it becomes possible to easily insert the cover portion E into the through-hole 15 of the module substrate 11.

Figure 7B:
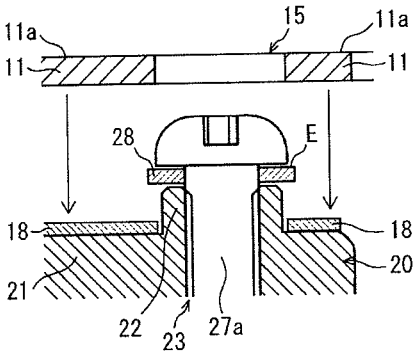
Figure 7C:
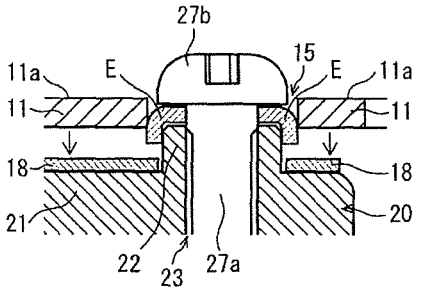
Figure 7D:
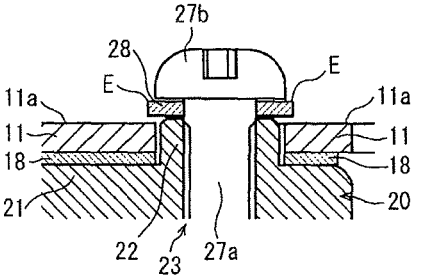

In the example shown in FIGS. 7B to 7D, a rubber washer made of an elastic material such as fluororubber or the like is used as the washer 28. In this case, as shown in FIG. 7C, when one attempts to pass the protrusion 22 and the washer 28 through the through-hole 15 of the module substrate 11, the cover portion E is elastically deformed. This makes it possible to easily mount the module substrate 11.

Furthermore, the protrusion 22 and the cover portion E may be one-piece formed by an elastically deformable resin. Even in this case, the same effect as mentioned above can be obtained.

Figure 8A:
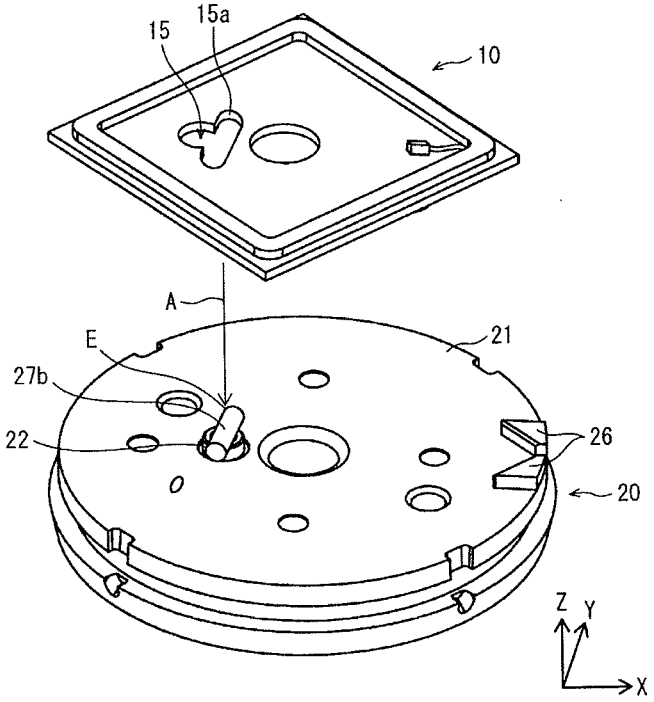
FIGS. 8A and 8B are perspective views showing a removal-preventing mechanism according to a modified example.
Figure 8B:
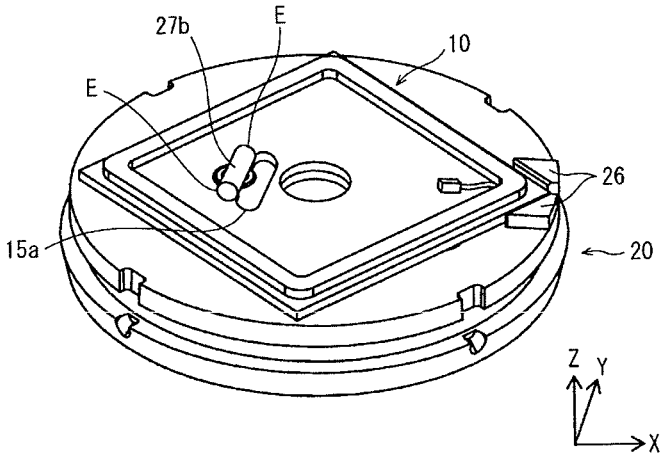

In the example shown in FIGS. 8A and 8B, the cover portion E cannot pass through the through-hole 15 when the light emitting module 10 is positioned in place on the mounting surface 21. If the position of the light emitting module 10 is shifted, the cover portion E can pass through the through-hole 15.

FIG. 8B shows a state in which the light emitting module 10 is mounted in place on the mounting surface 21. FIG. 8A shows a state in which the cover portion E passes through the through-hole 15 when the light emitting module 10 is mounted to the mounting surface 21.

When compared with the mounted state shown in FIG. 8B, the light emitting module 10 is shifted in the direction opposite to the X direction in the state shown in FIG. 8A.

Prior to mounting the light emitting module 10, as shown in FIG. 8A, a fastener having a head portion 27*b* is fastened beforehand to the protrusion 22 of the base 20, thereby fixing the head portion 27*b* to the top portion of the protrusion 22 and forming the cover portion E. Moreover, a slot portion 15*a* is formed in the through-hole 15 of the module substrate 11 so that the cover portion E can pass through the slot portion 15*a*. An adhesive agent is coated on the mounting surface 21 or the rear surface of the module substrate 11.

As indicated by an arrow A in FIG. 8A, the light emitting module 10 is caused to approach the mounting surface 21, whereby the head portion 27*b* and the protrusion 22 are inserted into the through-hole 15.

Then, the light emitting module 10 is caused to slide in the X direction and is mounted on the mounting surface 21 of the base 20 as shown in FIG. 8B, whereby the module substrate 11 is bonded to the mounting surface 21 through an adhesive layer.

When the light emitting module 10 is mounted on the mounting surface 21 in this way, the cover portion E covers the edge of the through-hole 15 of the module substrate 11. Moreover, a gap is provided between the cover portion E and the module substrate 11. Thus, the module substrate 11 is not pressed by the cover portion E.

If the adhesive layer is degraded and if the light emitting module 10 is detached from the mounting surface 21, the cover portion E comes into contact with the edge of the through-hole 15 of the module substrate 11. Thus, the removal of the light emitting module 10 is prevented.

5.In the light emitting module 10, the through-hole 15 is formed in the module substrate 11 and the protrusion 22 protruding from the mounting surface 21 is passed through the through-hole 15. However, the protrusion 22 need not necessarily pass through the through-hole 15.

Figure 9A:
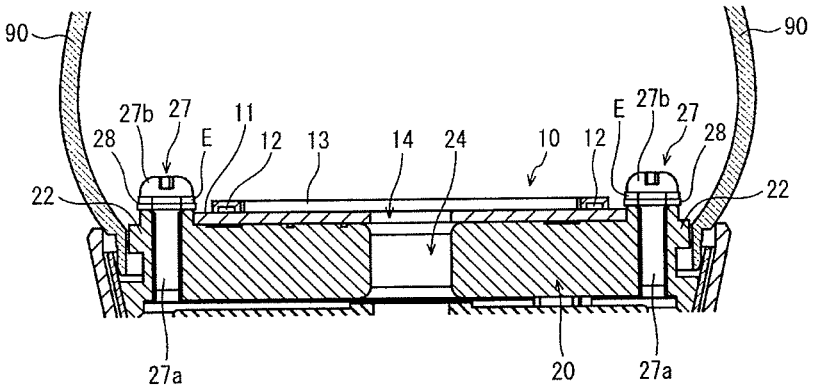
FIGS. 9A and 9B are perspective views showing a removal-preventing mechanism according to another modified example.
Figure 9B:
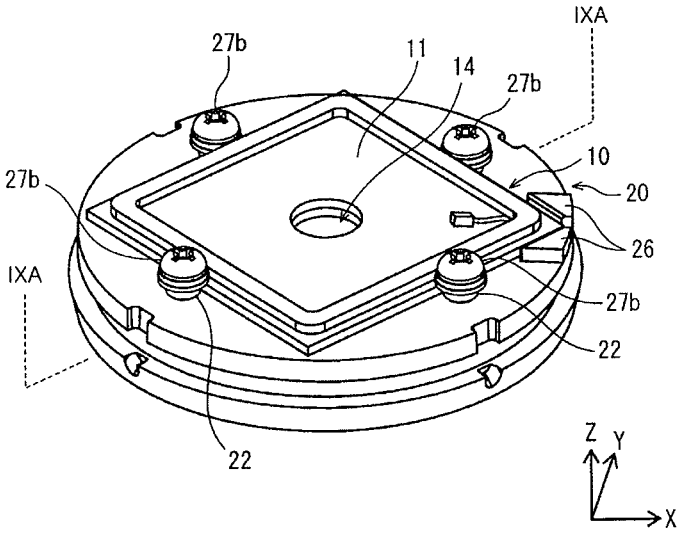

FIG. 9A is a sectional view showing major parts of a lamp according to a modified example. FIG. 9B is a perspective view of the major parts thereof.

As shown in FIGS. 9A and 9B, protrusions 22 are provided in close proximity to the outer edge of the module substrate 11. A fastener 27 having a head portion 27*b* is fastened to each of the protrusions 22. An cover portion E that covers the outer edge portion of the module substrate 11 is formed by the head portion 27*b*.

More specifically, as shown in FIG. 9B, the protrusions 22 and the cover portions E are provided in the base 20 in an adjoining relationship with four outer edges of the module substrate 11 mounted to the base 20. As with the aforementioned examples, the module substrate 11 is bonded to the mounting surface of the base 20 through an adhesive layer.

In the meantime, the light emitting unit is not formed in the outer edge region of the module substrate 11 of the light emitting module 10. The respective cover portions E cover the outer edge region of the module substrate 11 where the light emitting unit does not exist.

The sectional view shown in FIG. 9A is taken along line IXA-IXA in FIG. 9B. As shown in FIG. 9A, the cover portions E formed of the head portions 27*b* of the fasteners 27 do not make contact with the upper surface of the module substrate 11. For that reason, the module substrate 11 does not receive any pressing force from the respective cover portions E. Thus, a crack is hard to occur in the module substrate 11.

Even if the adhesive layer is degraded, the cover portions E prevent the module substrate 11 from being removed from the base 20.

In the example shown in FIGS. 9A and 9B, the protrusions 22 and the cover portions E are formed at four points in a corresponding relationship with four sides of the module substrate 11. However, even if the protrusions 22 and the cover portions E are formed only at three points in a corresponding relationship with three sides of the module substrate 11, it is possible to reliably prevent removal of the light emitting module 10.

Moreover, even if the protrusions 22 and the cover portions E are formed only at two points in a corresponding relationship with two opposite sides of the module substrate 11 or even if the protrusion 22 and the cover portion E are formed at one point, it is possible to prevent removal of the light emitting module 10 as long as the function of the adhesive layer remains to a certain degree.

In addition, a cutout may be formed in the outer periphery portion of the module substrate 11. A protrusion 22 may be formed so as to pass through the cutout. A cover portion E may be provided at the protrusion 22. In this case, the protrusion 22 is provided in close proximity to the inner edge of the cutout. The cover portion E is provided so as to cover the inner edge portion of the module substrate 11 without pressing the same.

<Others>

In the aforementioned embodiment, description has been made by taking a bulb type LED lamp as an example. However, the present invention is equally applicable to an illumination device in which a light emitting module provided with a semiconductor light emitting elements is mounted to a base.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. An illumination device, comprising:

a light emitting module including a module substrate and a semiconductor light emitting element mounted to the module substrate;

a base including a mounting surface on which the light emitting module is mounted; and a cover portion configured to cover an edge portion of the module substrate with a clearance between the cover portion and the edge portion and without pressing the edge portion, wherein the module substrate includes a surface which is directly bonded to the mounting surface of the base through an adhesive layer, and wherein the base includes a protrusion provided to protrude upward from the mounting surface without being covered by the module substrate and the cover portion is provided on the protrusion.

2. The illumination device of claim 1, wherein a through-hole is formed in a region of the module substrate excluding a region where the semiconductor light emitting element exists, the protrusion passing through the through-hole; and the edge portion of the module substrate includes an edge of the through-hole.

3. The illumination device of claim 1, wherein the cover portion is larger in diameter than the protrusion and is fixed to a top portion of the protrusion.

4. The illumination device of claim 2, wherein the cover portion is larger in diameter than the protrusion and is fixed to a top portion of the protrusion.

5. The illumination device of claim 1, wherein the cover portion is fixed to the protrusion by a shaft having a head portion and mounted to the base.

6. The illumination device of claim 2, wherein the cover portion is fixed to the protrusion by a shaft having a head portion and mounted to the base.

7. The illumination device of claim 1, wherein the base further includes a rib provided on the mounting surface thereof, the rib serving to position the module substrate on the mounting surface.

8. The illumination device of claim 2, wherein the base further includes a rib provided on the mounting surface thereof, the rib serving to position the module substrate on the mounting surface.

9. The illumination device of claim 1, wherein the module substrate is made of a ceramic material.

10. The illumination device of claim 2, wherein the module substrate is made of a ceramic material.

11. The illumination device of claim 1, wherein the adhesive layer is made of a thermally conductive material.

12. The illumination device of claim 2, wherein the adhesive layer is made of a thermally conductive material.

13. The illumination device of claim 1, wherein the adhesive layer covers only a portion of the surface of the module substrate.

14. The illumination device of claim 2, wherein the adhesive layer covers only a portion of the surface of the module substrate.

15. The illumination device of claim 1, further comprising:

a circuit unit configured to drive the light emitting module and a circuit case accommodating and holding the circuit unit in an internal space of the circuit case, the circuit unit and the circuit case being provided at the side of a rear surface of the base opposite to the mounting surface, wherein the circuit case includes a tubular portion having an opening disposed so as to face toward the rear surface and an insulation portion interposed between the rear surface of the base and the circuit unit so as to cover the opening of the tubular portion, and the insulation portion includes a window through which the internal space of the circuit case leads to the rear surface of the base.

16. The illumination device of claim 1, wherein the clearance is directly between the cover portion and the edge portion and comprises an empty space.

17. The illumination device of claim 16, wherein the cover portion is above the edge portion in a vertical direction perpendicular to the surface of the module substrate, the clearance being directly between the cover portion and the edge portion in the vertical direction.

* * * * *